US008111219B2

(12) United States Patent
Kim

(10) Patent No.: US 8,111,219 B2
(45) Date of Patent: Feb. 7, 2012

(54) PIXEL, ORGANIC LIGHT EMITTING DISPLAY USING THE SAME, AND ASSOCIATED METHODS

(75) Inventor: Yang-wan Kim, Suwon-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 1010 days.

(21) Appl. No.: 12/073,268

(22) Filed: Mar. 3, 2008

(65) Prior Publication Data

US 2008/0224965 A1 Sep. 18, 2008

(30) Foreign Application Priority Data

Mar. 14, 2007 (KR) ..... 10-2007-0025063

(51) Int. Cl.
*G09G 3/30* (2006.01)

(52) U.S. Cl. ..... 345/76; 345/81

(58) Field of Classification Search ..... None
See application file for complete search history.

(56) References Cited

U.S. PATENT DOCUMENTS

| | | | | |
|---|---|---|---|---|
| 7,382,340 | B2 | 6/2008 | Kim et al. | |
| 7,460,093 | B2 | 12/2008 | Ozawa et al. | |
| 2005/0179625 | A1 | 8/2005 | Choi et al. | |
| 2005/0200575 | A1* | 9/2005 | Kim et al. | 345/76 |
| 2005/0280614 | A1 | 12/2005 | Goh | |
| 2006/0022305 | A1 | 2/2006 | Yamashita | |
| 2006/0066254 | A1 | 3/2006 | Sasaki et al. | |
| 2006/0253755 | A1 | 11/2006 | Wu | |
| 2006/0256058 | A1 | 11/2006 | Asano et al. | |
| 2007/0046593 | A1* | 3/2007 | Shin | 345/81 |

FOREIGN PATENT DOCUMENTS

| | | | |
|---|---|---|---|
| CN | 1 677 470 | A | 10/2005 |
| EP | 1 708 162 | A1 | 10/2006 |
| JP | 06-266313 | | 2/1994 |
| JP | 2005-189695 | A | 7/2005 |
| JP | 2005-202255 | A | 7/2005 |
| JP | 2005-331959 | A | 12/2005 |
| JP | 2006-011435 | | 1/2006 |
| JP | 2006-011435 | A | 1/2006 |

(Continued)

OTHER PUBLICATIONS

European Office Action in EP 08152784.8-1228/1970885, dated Dec. 9, 2010 (Kim).

*Primary Examiner* — Sumati Lefkowitz
*Assistant Examiner* — Ieesha Gillis
(74) *Attorney, Agent, or Firm* — Lee & Morse, P.C.

(57) ABSTRACT

A pixel including an OLED, the pixel including a first transistor coupled between a data line and a first node, the first transistor being turned on by a low signal on an i-th scan line, a second transistor coupled between a first power source and a fifth transistor, a third transistor coupled between the gate electrode of the second transistor and an electrode of the second transistor that is coupled to the fifth transistor, the third transistor being turned on by a low signal on an (i−1)-th scan line, a fourth transistor coupled between a first reference voltage and the first node, the fourth transistor being turned on by the low signal on the (i−1)-th scan line, a storage capacitor coupled between the first node and the second node, and a compensator controlling a voltage of the second node corresponding to degradation of the OLED.

19 Claims, 3 Drawing Sheets

FOREIGN PATENT DOCUMENTS

| | | | | |
|---|---|---|---|---|
| JP | 2006-038963 | A | | 2/2006 |
| JP | 2006-146219 | A | | 6/2006 |
| JP | 2006-243526 | A | | 9/2006 |
| JP | 2006-251632 | A | | 9/2006 |
| JP | 2007-052432 | A | | 3/2007 |
| KR | 10-2005-0105582 | A | | 11/2005 |
| KR | 10-2006-0033376 | A | | 4/2006 |
| KR | 10-2006-0043679 | A | | 5/2006 |
| KR | 10-2006-0064194 | A | | 6/2006 |
| KR | 10-2006-0072784 | A | | 6/2006 |
| KR | 10-2007-0002189 | A | | 1/2007 |
| KR | 10-2007-0015824 | A | * | 2/2007 |

* cited by examiner

PIXEL, ORGANIC LIGHT EMITTING DISPLAY USING THE SAME, AND ASSOCIATED METHODS

BACKGROUND OF THE INVENTION

1. Field of the Invention

Embodiments relate to a pixel, a display using the same, and associated methods. More particularly, embodiments relate to a pixel, a display using the same, and associated methods, in which degradation of an organic light emitting diode is automatically compensated.

2. Description of the Related Art

In the manufacture and operation of a display, e.g., a display used to reproduce text, images, video, etc., uniform operation of pixel elements of the display is highly desirable. However, providing such uniform operation may be difficult. For example, in some display technologies, e.g., those utilizing electroluminescent elements such as organic light emitting diodes (OLEDs), operational characteristics, e.g., luminance, of the pixel elements may change over time. Accordingly, there is a need for a display adapted to compensate for changes in the operational characteristics of pixel elements.

SUMMARY OF THE INVENTION

Embodiments are therefore directed to a pixel, a display using the same, and associated methods, which substantially overcome one or more of the problems due to the limitations and disadvantages of the related art.

It is therefore a feature of an embodiment to provide a pixel, a display using the same, and associated methods, in which a drive transistor for an OLED is controlled by a voltage that is adjusted in accordance with a resistance of the OLED.

At least one of the above and other features and advantages may be realized by providing a pixel, the pixel including an OLED, a first transistor coupled between a data line and a first node, the first transistor being turned on by a low signal on an i-th scan line, a second transistor coupled between a first power source and a fifth transistor, a third transistor coupled between the gate electrode of the second transistor and an electrode of the second transistor that is coupled to the fifth transistor, the third transistor being turned on by a low signal on an (i−1)-th scan line, a fourth transistor coupled between a first reference voltage and the first node, the fourth transistor being turned on by the low signal on the (i−1)-th scan line, a storage capacitor coupled between the first node and the second node, and a compensator controlling a voltage of the second node corresponding to degradation of the OLED. The second transistor may have a gate electrode coupled to a second node, the fifth transistor may be coupled between the second transistor and the OLED, and the fifth transistor may be turned on by a low signal on an i-th emission control line.

The voltage of the second node may be controlled to increase a voltage applied to the OLED as the resistance of the OLED increases. The compensator may include a feedback capacitor coupled between the first node and a third node, and a sixth transistor and a seventh transistor disposed in series between a second reference voltage and a fourth node. The third node may be between the sixth and seventh transistors, and the fourth node may be between the fifth transistor and the OLED. The sixth transistor may be coupled between the third node and the fourth node, the seventh transistor may be coupled between the second reference voltage and the third node, the sixth transistor may be turned on by the low signal on the i-th scan line, and the seventh transistor may be turned off by the low signal on the i-th scan line.

A voltage of the third node may be set to a voltage applied to the OLED when the sixth transistor is turned on, and the voltage of the third node may be increased from the voltage applied to the OLED to the second reference voltage when the seventh transistor is turned on. The feedback capacitor may transfer a voltage change of the third node to the first node. The first reference voltage may be set to a voltage of the first power source, and the second reference voltage may be set to the first reference voltage.

The first reference voltage may be set to a voltage of the first power source. The first transistor may be turned on by the low signal on the i-th scan line after the third and fourth transistors are turned on by the low signal on the (i−1)-th scan line. The fifth transistor may be turned off by a high signal on the i-th emission control line after the third and fourth transistors are turned on by the low signal on the on the (i−1)-th scan line, and the fifth transistor may be turned on by the low signal on the i-th emission control line before the first transistor is turned on by the low signal on the i-th scan line.

At least one of the above and other features and advantages may also be realized by providing a display, including a scan driver coupled to scan lines and emission control lines, a data driver coupled data lines, and pixels including respective OLEDs. The pixels may be coupled to respective scan, emission control, and data lines; and may include a first transistor coupled between a data line and a first node, the first transistor being turned on by a low signal on an i-th scan line, a second transistor coupled between a first power source and a fifth transistor, a third transistor coupled between the gate electrode of the second transistor and an electrode of the second transistor that is coupled to the fifth transistor, the third transistor being turned on by a low signal on an (i−1)-th scan line, a fourth transistor coupled between a first reference voltage and the first node, the fourth transistor being turned on by the low signal on the (i−1)-th scan line, a storage capacitor coupled between the first node and the second node, and a compensator controlling a voltage of the second node corresponding to degradation of the OLED. The second transistor may have a gate electrode coupled to a second node, the fifth transistor may be coupled between the second transistor and the OLED, and the fifth transistor may be turned on by a low signal on an i-th emission control line The scan driver may supply a scan signal having a low pulse to the (i−1)-th scan line and may subsequently supply the scan signal to the i-th scan line, the scan driver may supply an emission control signal having a high pulse to the i-th emission control line, the emission control pulse on the i-th emission control line may transition high after the scan signal on the (i−1)-th scan line transitions low, and the emission control pulse on the i-th emission control line may transition low after the scan signal on the (i−1)-th scan line transitions high.

At least one of the above and other features and advantages may also be realized by providing a method for driving a display, including initializing a gate electrode of a drive transistor during an initial time period while a low scan signal is supplied to an (i−1)-th scan line, supplying a high emission control signal to an i-th emission control line after the initial time period and maintaining the high emission control signal while the low scan signal is supplied to the (i−1)-th scan line in order to charge a storage capacitor with a voltage corresponding to a threshold voltage of the drive transistor, charging the storage capacitor with a voltage corresponding to a data signal while a low scan signal is supplied to an i-th scan line, and controlling a voltage of the gate electrode of the drive transistor in correspondence with degradation of an OLED. Initializing the gate electrode of the drive transistor during the initial time period may include applying a first reference voltage to a first electrode of a storage capacitor, a second electrode of the storage capacitor being coupled to the gate electrode of the drive transistor.

Controlling the voltage of the gate electrode of the drive transistor may include providing a voltage of an anode electrode of the OLED to a first terminal of a feedback capacitor while the low scan signal is supplied to the i-th scan line, and increasing a voltage of the first terminal of the feedback capacitor while a high scan signal is supplied to the i-th scan line. A second terminal of the feedback capacitor may be coupled to a first terminal of the storage capacitor, and a second terminal of the storage capacitor may be coupled to the gate electrode of the drive transistor. Controlling the voltage of the gate electrode of the drive transistor may further include reducing a voltage change of the first terminal of the feedback capacitor in correspondence with increasing resistance of the OLED. Controlling the voltage of the gate electrode of the drive transistor may further include reducing the voltage of a gate electrode of the drive transistor in correspondence with the reduction in the voltage change of the first terminal of the feedback capacitor. Controlling the voltage of the gate electrode of the drive transistor may further include increasing an electric current supplied to the OLED by the drive transistor in correspondence with the reduction in the voltage of the gate electrode of the drive transistor. Controlling the voltage of the gate electrode of the drive transistor may further include increasing the voltage of the first terminal of the feedback capacitor to a second reference voltage while the high scan signal is supplied to the i-th scan line.

A scan signal having a low pulse may be supplied to the (i−1)-th scan line and subsequently supplied to the i-th scan line, an emission control signal having a high pulse may be supplied to the i-th emission control line, the emission control pulse on the i-th emission control line may transition high after the scan signal on the (i−1)-th scan line transitions low, and the emission control pulse on the i-th emission control line may transition low after the scan signal on the (i−1)-th scan line transitions high.

BRIEF DESCRIPTION OF THE DRAWINGS

The above and other features and advantages will become more apparent to those of ordinary skill in the art by describing in detail example embodiments with reference to the attached drawings, in which.

DETAILED DESCRIPTION OF THE INVENTION

Figure 1:
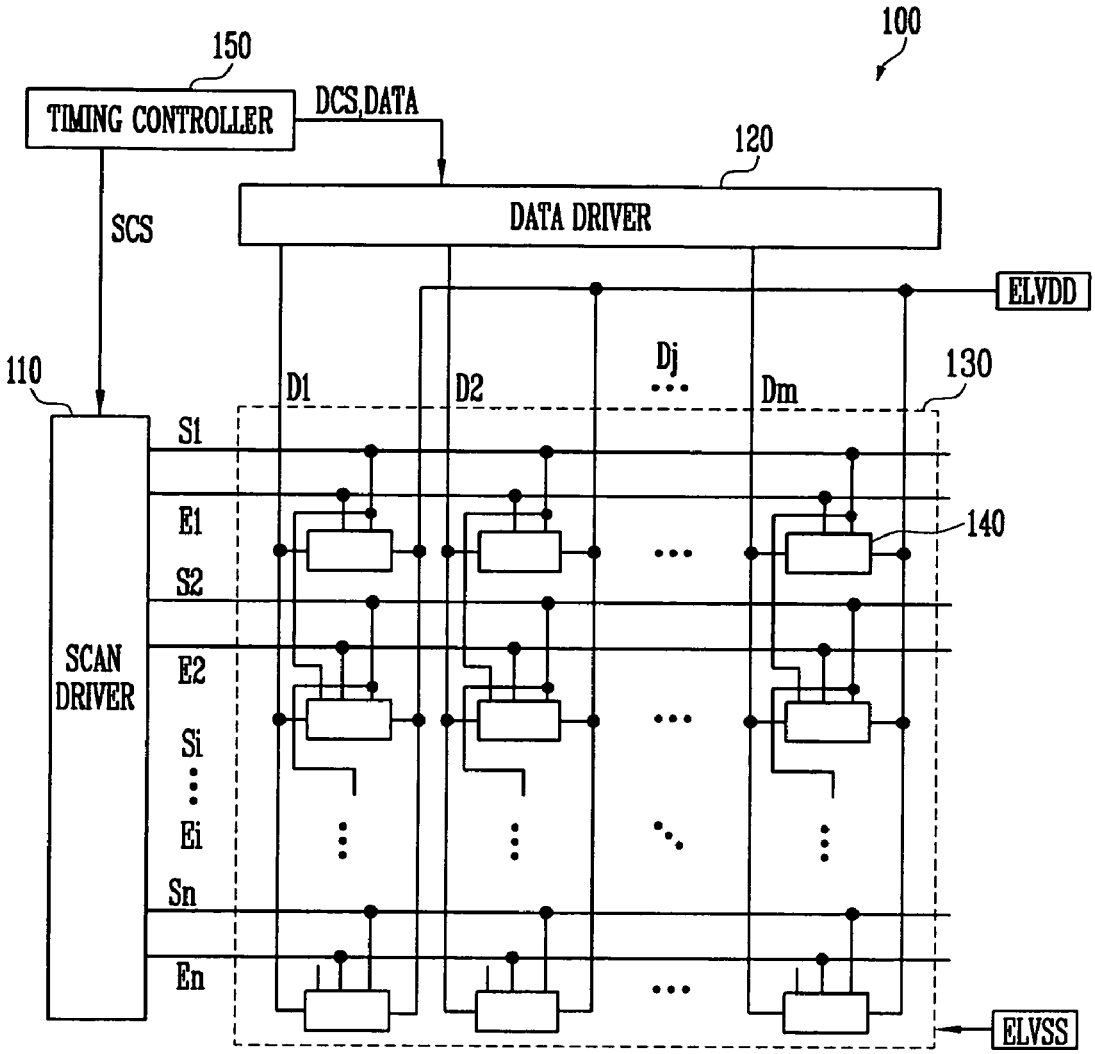
FIG. 1 illustrates a schematic view of a display according to an embodiment.

Korean Patent Application No. 10-2007-0025063, filed on Mar. 14, 2007, in the Korean Intellectual Property Office, and entitled: "Pixel, Organic Light Emitting Display Using the Same and Driving Method Thereof" is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers and regions may be exaggerated, or elements may be omitted, for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present.

Similarly, where an element is described as being coupled to a second element, the element may be directly coupled to second element, or may be indirectly coupled to second element via one or more other elements. Further, where an element is described as being coupled to a second element, it will be understood that the elements may be electrically coupled, e.g., in the case of transistors, capacitors, power sources, nodes, etc. Where two or more elements are described as being coupled to a node, the elements may be directly coupled to the node, or may be coupled via conductive features to which the node is common. Thus, where embodiments are described or illustrated as having two or more elements that are coupled at a common point, it will be appreciated that the elements may be coupled at respective points on a conductive feature that extends between the respective points. Like reference numerals refer to like elements throughout.

FIG. 1 illustrates a schematic view of a display 100 according to an embodiment. With reference to FIG. 1, the display 100 may include a plurality of pixels 140 each coupled to an electroluminescent element, e.g., an OLED. The display 100 may group sets of pixels 140, each controlling display of a predetermined color of light, into a logical pixel, i.e., a pixel defining a display resolution. For example, the display 100 may group sets of red, green, and blue light pixels 140 into a logical pixel. In such a case, each pixel 140 forming the set may correspond to a sub-pixel. For clarity, in the description that follows no distinction will be made between sub-pixels of various colors. It will be appreciated, however, that the features described herein may be applied to monochrome displays, individual light emitting elements, color displays, etc.

The display 100 may include a pixel portion 130 having the pixels 140, a scan driver 110, a data driver 120, and a timing controller 150. The plurality of pixels 140 may be coupled to scan lines S1 to Sn, emission control lines E1 to En, and data lines D1 to Dm. The scan driver 110 may drive the scan lines S1 to Sn with a scan signal applied sequentially from S1 to Sn, and may drive the emission control lines E1 to En with an emission control signal applied sequentially thereto. The data driver 120 may drive the data lines D1 to Dm. The timing controller 150 may control the scan driver 110 and the data driver 120.

Each pixel 140 may be coupled to a respective one of the scan lines S1 to Sn, e.g., a scan line Si, where i is from 1 to n, inclusive. Each pixel 140 may also be coupled to a corresponding one of the emission control lines E1 to En, e.g., Ei, as well as one of the data lines D1 to Dm, e.g., Dj, where j is from 1 to m, inclusive. Further, each pixel 140 may be coupled to a scan line Si−1 that is scanned earlier in time. For example, where the pixels 140 are arranged in rows and columns in the display 100, each pixel 140 in a row i may be coupled to a scan line Si as well as a scan line Si−1 of a row i−1, which receives the scan signal prior to the row i. Further, a 0-th scan line S0 (not shown), i.e., Si−1 where i=1, may also be formed in the pixel portion 130 to provide an initialization operation to pixels driven by the first scan line S1.

The pixel portion 130 may receive externally-supplied power from a first power source ELVDD and a second power source ELVSS. The first power source ELVDD may be set to a voltage higher than that of the second power source ELVSS. Each pixel 140 may control an amount of electric current flowing from the first power source ELVDD through the OLED to the second power source ELVSS. The OLED may generate light of a predetermined luminance based on the amount of current flowing therethrough. In particular, each of the pixels 140 may include a drive transistor for supplying an electric current to the OLED. As described herein, embodiments may provide a voltage to a gate electrode of the drive transistor that is controlled to compensate for changing resistance in the OLED, e.g., an increased resistance resulting from degradation of the OLED.

The timing controller 150 may generate a data driving signal DCS and a scan driving signal SCS corresponding to externally-supplied synchronizing signals. The data driving signal DCS may be provided to the data driver 120, and the scan driving signal SCS may be provided to the scan driver 110. Further, the timing controller 150 may provide externally-supplied data DATA to the data driver 120.

The scan driver 110 may receive the scan driving control signal SCS from the timing controller 150 and sequentially provide a scan signal to the scan lines S1 through Sn. Further, the scan driver 110 may sequentially provide an emission control signal to the emission control lines E1 to En. In an implementation, the scan signal may include a negative voltage pulse, i.e., a low pulse, and the emission control signal may include a positive voltage pulse, i.e., a high pulse. The data driver 120 may receive the data driving signal DCS and the data DATA, and may generate and provide data signals to the data lines D1 through Dm.

Figure 2:
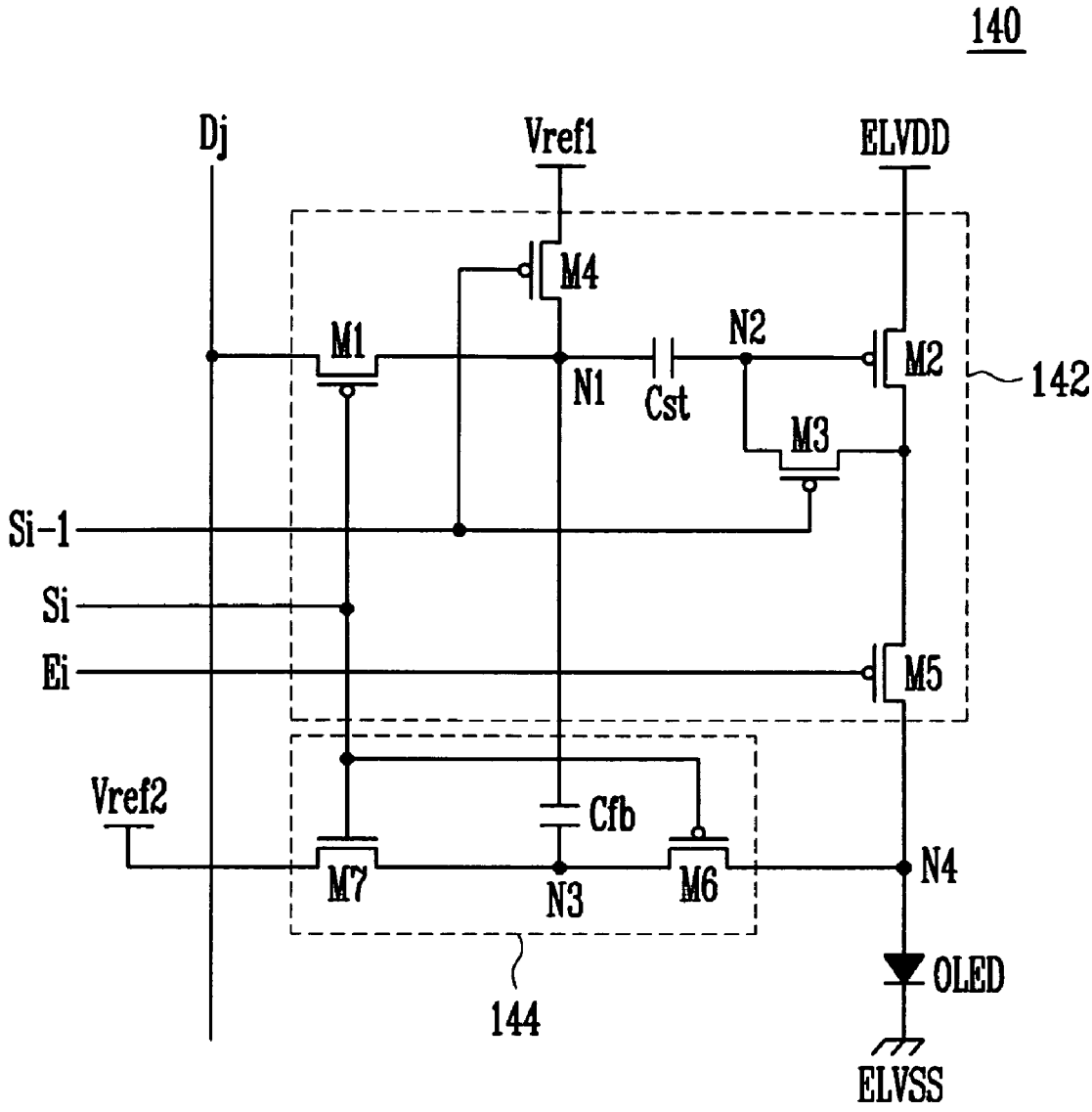
FIG. 2 illustrates a schematic circuit diagram of a pixel according to an embodiment.

FIG. 2 illustrates a schematic circuit diagram of a pixel 140 according to an embodiment. For convenience of description, FIG. 2 shows an example pixel 140 coupled to an (i−1)-th scan line Si−1, an i-th scan line Si, an i-th emission control line Ei, and a j-th data line Dj. With reference to FIG. 2, the pixel 140 may be coupled to an electroluminescent element such as an OLED. The pixel 140 may include a pixel circuit 142 and a compensator 144. The pixel circuit 142 may include five transistors M1 to M5 and a storage capacitor Cst. The second transistor M2 may be a drive transistor. The compensator 144 may include a sixth transistor M6, a seventh transistor M7, and a feedback capacitor Cfb The pixel circuit 142 may control an amount of an electric current supplied to the OLED and the compensator 144 may compensate for degradation in the OLED, e.g., an increase in resistance resulting from degradation of the OLED. An anode electrode of the OLED may be coupled to the pixel circuit 142, and a cathode electrode of the OLED may be coupled to the second power source ELVSS. The OLED may generate light of a predetermined luminance corresponding to an electric current supplied from the pixel circuit 142, which controls the electric current supplied to the OLED.

Degradation of the OLED, e.g., due to operation thereof or exposure to environmental factors, may occur over time, and may lead to a change in resistance of the OLED. According to embodiments, as the resistance changes, a voltage applied to the OLED may be compensated, e.g., by increasing the voltage to compensate for an increased resistance. In particular, an electric current flowing from the second transistor M2 to the OLED may be controlled to maintain a uniform light output from the OLED by increasing the voltage applied to the OLED in response to increasing resistance thereof.

An amount of an electric current supplied to the OLED from the second transistor M2 may be increased for a given data signal, i.e., the electric current supplied to the OLED may be increased as the OLED degrades. Thus, embodiments may compensate so as to maintain luminance if the OLED degrades.

In the pixel circuit 142, a gate electrode of the first transistor M1 may be coupled to the i-th scan line Si, a first electrode of the first transistor M1 may be coupled to the data line Dj, and a second electrode of the first transistor M1 may be coupled to the first node N1. When the scan signal supplied to the scan line Si is at a low level, the first transistor M1 may transfer the data signal from the data line Dj to the first node N1.

The second transistor M2 may be the drive transistor. A gate electrode of the second transistor M2 may be coupled to the second node N2, and a first electrode of the second transistor M2 may be coupled to the first power source ELVDD. A second electrode of the second transistor M2 may be coupled to a first electrode of the fifth transistor M5. The second transistor M2 may control the amount of electric current flowing from the first power source ELVDD to the second power source ELVSS through the OLED in correspondence with a voltage at the gate electrode.

A gate electrode of the third transistor M3 may be coupled to the (i−1)-th scan line Si−1, a first electrode of the third transistor M3 may be coupled to the second electrode of the second transistor M2, and a second electrode of the third transistor M3 may be coupled to the second node N2. When the scan signal supplied to the (i−1)-th scan line Si−1 is low, the third transistor M3 may be turned on to couple the second electrode of the second transistor M2 to the gate thereof.

A gate electrode of the fourth transistor M4 may be coupled to the (i−1)-th scan line Si−1, a first electrode of the fourth transistor M4 may be coupled to the first reference voltage Vref1, and a second electrode of the fourth transistor M4 may be coupled to the first node N1. When the scan signal supplied to the (i−1)-th scan line Si−1 is low, the fourth transistor M4 may be turned on to supply the first reference voltage Vref1 to the first node N1. The first reference voltage Vref1 may be set to the same voltage as that of the first power source ELVDD, and may be set to a voltage higher than that of the data signal.

A gate electrode of the fifth transistor M5 may be coupled to the emission control line Ei, the first electrode of the fifth transistor M5 may be coupled to the second electrode of the second transistor M2, and a second electrode of the fifth transistor M5 may be coupled to the OLED. When an emission control signal supplied to the fifth transistor M5 is low, the fifth transistor M5 may be turned on, and when the emission signal is high, the fifth transistor M5 may be turned off.

The storage capacitor Cst may be disposed between the first node N1 and the second node N2. The storage capacitor Cst may be charged with a voltage corresponding to the data signal and a threshold voltage of the second transistor M2, as described in detail below.

The compensator 144 may adjust a voltage of the gate electrode of the second transistor M2, via the second node N2, in correspondence with degradation of the OLED, i.e., the compensator 144 may control the voltage of the second node N2 to offset changes in resistance of the OLED. As noted above, the compensator 144 may include the sixth transistor M6, the seventh transistor M7, and the feedback capacitor Cfb. The feedback capacitor Cfb may transfer a voltage change of the third node N3 to the first node N1, as described in detail below. The seventh transistor M7 may be a transistor of a different conductive type from that of each of the first to sixth transistors M1 to M6. The seventh transistor may be an NMOS transistor and the first to sixth transistors M1 to M6 may be PMOS transistors.

A second electrode of the sixth transistor M6 may be coupled to an anode electrode of the OLED via a fourth node N4, a first electrode of the sixth transistor M6 may be coupled to the third node N3, and gate electrode of the sixth transistor M6 may be coupled to the i-th scan line Si. When the scan signal supplied to the i-th scan line Si is low, the sixth transistor M6 may be turned on to couple the third node N3 to the anode electrode of the OLED, and may thus change a voltage of the third node N3 to be that of the OLED anode. The seventh transistor M7 may be turned off when the sixth transistor M6 is turned on.

A first electrode of the seventh transistor M7 may be coupled to a second reference voltage Vref2, a second electrode of the seventh transistor M7 may be coupled to the third node N3, and a gate electrode of the seventh transistor M7 may be coupled to the i-th scan line Si. When the scan signal supplied to the i-th scan line Si is low, the seventh transistor M7 may be turned off, and when the scan signal supplied to the i-th scan line Si is high, the seventh transistor M7 may be turned on. The second reference voltage Vref2 may have a voltage greater than that applied to the OLED. For example, the second reference voltage Vref2 may be set to the same voltage as that of the first reference voltage Vref1.

Referring again to FIG. 2, a voltage change occurring at a third node N3 may be used to adjust the operation of the second transistor M2. As the OLED is degraded, increasing resistance of the OLED results in an increase in the voltage supplied to the third node N3. This changes a voltage charged in a feedback capacitor Cfb that is coupled to the third node N3. The voltage charged in the feedback capacitor may be lower as the OLED is degraded. In turn, voltages of a first node N1 and a second node N2 coupled to the second transistor M2 are also reduced. Thus, an amount of an electric current supplied to the OLED from the second transistor M2 may be increased for a given data signal, i.e., the electric current supplied to the OLED may be increased as the OLED degrades.

Figure 3:
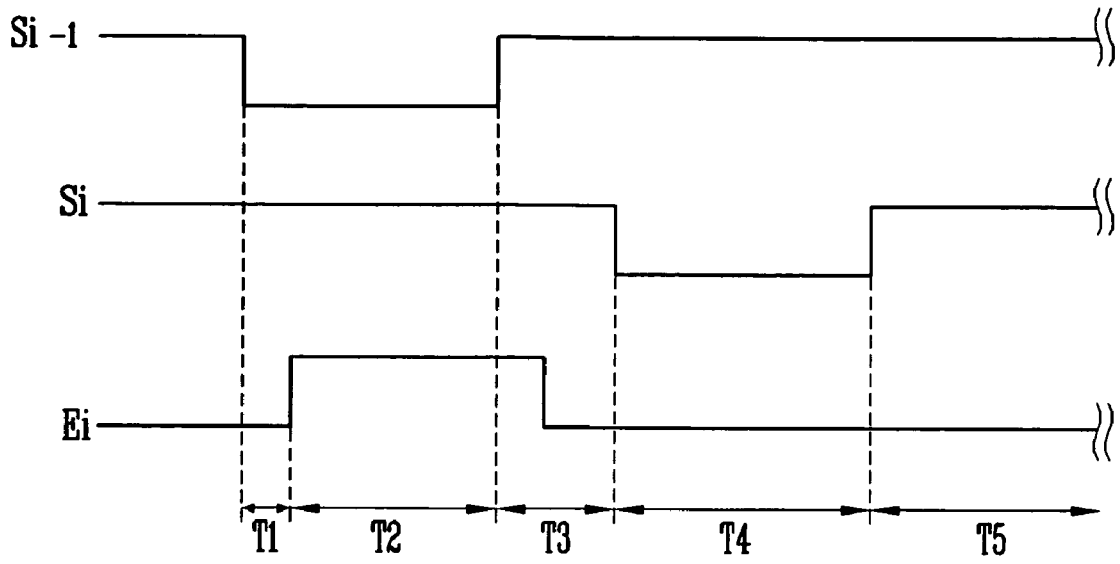
FIG. 3 illustrates a waveform diagram for a method of driving a display according to an embodiment.

FIG. 3 illustrates a waveform diagram for a method of driving a display according to an embodiment. With reference to FIGS. 2 and 3, a scan signal having a low level may be supplied to an (i−1)-th scan line Si−1 during a first time period T1. When the scan signal supplied to the (i−1)-th scan line Si−1 is low, the fourth transistor M4 and the third transistor M3 may be turned on. The emission signal supplied to the emission control line Ei may be low during the first time period T1. When the emission signal supplied to the emission control line Ei is low, the fifth transistor M5 may be turned on.

When the fourth transistor M4 is turned-on, a voltage of the first reference voltage Vref1 may be supplied to the first node N1. When the voltage of the first reference voltage Vref1 is supplied to the first node N1, the voltage of the second node N2 may be increased. Thus, the voltage of the second node N2 may be increased by a voltage stored in the storage capacitor Cst during a previous time period.

With the third transistor M3 turned on, the second node N2 may be coupled to the second power source ELVSS through the fifth transistor M5 and the OLED. Thus, during the first time period T1, the voltage of the second node N2 may be initialized, and a charged stored in the storage capacitor Cst may correspond to a voltage difference between the first reference voltage Vref1 and the voltage at the anode electrode of the OLED.

During a second time period T2, the scan signal supplied to the (i−1)-th scan line Si−1 may be maintained low, and the second electrode and gate of the second transistor M2 may remain coupled. The emission control signal supplied to the emission control line Ei may be high, such that the fifth transistor M5 is turned off. As described above, during the first time period T1, the storage capacitor Cst may be charged with a voltage corresponding to the first reference voltage Vref1 and the voltage at the anode electrode of the OLED. During the second time period T2, a voltage obtained by subtracting a threshold voltage of the second transistor M2 from a voltage of the first power source ELVDD may be developed at the second node N2.

In particular, during the second time period T2, the voltage at the second node N2, which is applied to the gate electrode of the second transistor M2 by the storage capacitor Cst, may be initially low, placing the second transistor M2 in a conductive state. Further, the third transistor M3 may be turned on by the low scan signal supplied to the (i−1)-th scan line Si−1, thereby coupling the second node N2 to the second electrode of the second transistor M2. Accordingly, the voltage of the first power source ELVDD may flow through the second transistor M2 and the third transistor M3 to the second node N2 until the voltage of the second node N2 rises sufficiently to turn of the second transistor M2, i.e., until the voltage rises to the threshold voltage of the second transistor M2. Therefore, the storage capacitor Cst may be charged with a voltage corresponding to the threshold voltage of the second transistor M2. The voltage of the first reference voltage Vref1 may be the same as that of the first power source ELVDD, in which case the storage capacitor Cst may be charged with a voltage corresponding to the voltage of the first power source ELVDD minus the threshold voltage of the second transistor M2.

At the beginning of a third time period T3, the scan signal supplied to the (i−1)-th scan line Si−1 may go high. Further, during the third time period T3, the emission control signal supplied to the emission control line Ei may go low. The scan signal supplied to the i-th scan line Si may be maintained high. When the scan signal supplied to the (i−1)-th scan line Si−1 is high, the third transistor M3 and the fourth transistor M4 may be turned off, and when the emission control signal supplied to the emission control line Ei is low, the fifth transistor M5 may be turned on.

During a fourth time period T4, the scan signal supplied to the (i−1)-th scan line Si−1 may be maintained high, and the scan signal supplied to the i-th scan line Si may be low. When the scan signal supplied to the i-th scan line Si is low, the first transistor M1 and the sixth transistor M6 may be turned on, and the seventh transistor M7 may be turned off. When the first transistor M1 is turned on, the data signal supplied to the data line Di may be provided to the first node N1 through the first transistor M1. Thus, a voltage of the first node N1 may be reduced from a voltage of the reference voltage Vref1 to a voltage of the data signal. Further, a voltage of the second node N2 set in a floating state may be reduced corresponding to the reduction in voltage of the first node N1. The reduced voltage applied to the gate of the second transistor M2 supplies a predetermined current to the OLED through the fifth transistor M5, in correspondence with the voltage at the second node N2. Thus, a predetermined voltage may be supplied to the OLED. Further, the voltage applied to the OLED may be supplied to the third node N3 through the sixth transistor M6. Accordingly, during the fourth time period T4, when the voltage of the first node N1 changes corresponding to the data signal DATA, the third node N3 may be set to a voltage applied to the OLED.

Next, during a fifth time period T5, the scan signal supplied to the i-th scan line Si may transition high, turning off the first transistor M1 and the sixth transistor M6, and turning on the seventh transistor M7. When the seventh transistor M7 is turned on, a voltage of the third node N3 may be increased to a voltage of the second reference voltage Vref2. As the voltage of the third node N3 is increased from a voltage applied to the OLED to a voltage of the second reference voltage Vref2, the voltage of the first node N1 may also be increased, the voltage of the first node N1 changing corresponding to the voltage change of the third node N3.

When the voltage of the first node N1 is increased, the voltage of the second node N2 may also be increased. The second transistor M2 may supply an electric current, corresponding to a voltage applied to the gate electrode thereof, from the first power source ELVDD to the second power source ELVSS through the OLED. The OLED may generate light of predetermined luminance corresponding to the electric current supplied from the second transistor M2. Further, if the OLED degrades over time, the resistance thereof may increase. As the OLED degrades, a voltage applied to the OLED may be increased, such that, when the electric current is supplied from the second transistor M2, the voltage applied to the OLED is increased in view of the increased resistance of the OLED.

As the OLED degrades, the increase in voltage at the third node N3 may be lessened. In particular, as the OLED degrades, the voltage of the OLED that is supplied to the third node N3 may be increased, which causes the increase in voltage at the third node N3 to be less than it would be if the OLED were not degraded.

When the increase in voltage at the third node N3 is small, voltage increases at the first and second nodes N1 and N2 are also reduced. Accordingly, the amount of electric current supplied to the OLED from the second transistor M2 is increased for a given data signal. Thus, according to embodiments, as the OLED degrades, the amount of electric current supplied to the OLED from the second transistor M2 may be increased, thereby avoiding reductions in luminance due to degradation of the OLED.

As described above, in a circuit for an OLED, a display using the same, and associated methods, as the OLED is degraded, a lower voltage may be supplied to the gate electrode of the drive transistor, so that the luminance deterioration due to the degradation of the organic light emitting diode can be compensated.

Exemplary embodiments of the present invention have been disclosed herein, and although specific terms are employed, they are used and are to be appreciated in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A pixel, comprising:
an OLED;
a first transistor coupled between a data line and a first node, the first transistor being turned on by a low signal on an i-th scan line, i being a natural number;
a second transistor coupled between a first power source and a fifth transistor, wherein:
the second transistor has a gate electrode coupled to a second node,
the fifth transistor is coupled between the second transistor and the OLED, and
the fifth transistor is turned on by a low signal on an i-th emission control line;
a third transistor coupled between the gate electrode of the second transistor and an electrode of the second transistor that is coupled to the fifth transistor, the third transistor being turned on by a low signal on an (i−1)-th scan line;
a fourth transistor coupled between a first reference voltage and the first node, the fourth transistor being turned on by the low signal on the (i−1)-th scan line;
a storage capacitor coupled between the first node and the second node; and
a compensator controlling a voltage of the second node corresponding to degradation of the OLED,
wherein the compensator includes:
a feedback capacitor coupled between the first node and a third node; and
a sixth transistor and a seventh transistor disposed in series between a second reference voltage and a fourth node, wherein:
the third node is between the sixth and seventh transistors, and
the fourth node is between the fifth transistor and the OLED.

2. The pixel as claimed in claim 1, wherein the voltage of the second node is controlled to increase a voltage applied to the OLED as the resistance of the OLED increases.

3. The pixel as claimed in claim 1, wherein:
the sixth transistor is coupled between the third node and the fourth node,
the seventh transistor is coupled between the second reference voltage and the third node,
the sixth transistor is turned on by the low signal on the i-th scan line, and
the seventh transistor is turned off by the low signal on the i-th scan line.

4. The pixel as claimed in claim 1, wherein:
a voltage of the third node is set to a voltage applied to the OLED when the sixth transistor is turned on, and
the voltage of the third node is increased from the voltage applied to the OLED to the second reference voltage when the seventh transistor is turned on.

5. The pixel as claimed in claim 4, wherein the feedback capacitor transfers a voltage change of the third node to the first node.

6. The pixel as claimed in claim 1, wherein:
the first reference voltage is set to a voltage of the first power source, and the second reference voltage is set to the first reference voltage.

7. The pixel as claimed in claim 1, wherein the first reference voltage is set to a voltage of the first power source.

8. The pixel as claimed in claim 1, wherein the first transistor is turned on by the low signal on the i-th scan line after the third and fourth transistors are turned on by the low signal on the (i−1)-th scan line.

9. The pixel as claimed in claim 8, wherein:
the fifth transistor is turned off by a high signal on the i-th emission control line after the third and fourth transistors are turned on by the low signal on the on the (i−1)-th scan line, and
the fifth transistor is turned on by the low signal on the i-th emission control line before the first transistor is turned on by the low signal on the i-th scan line.

10. An organic light emitting display, comprising:
a scan driver coupled to scan lines and emission control lines;
a data driver coupled data lines; and
pixels including respective OLEDs, wherein the pixels are coupled to respective scan, emission control, and data lines, and include:

a first transistor coupled between a data line and a first node, the first transistor being turned on by a low signal on an i-th scan line, i being a natural number;

a second transistor coupled between a first power source and a fifth transistor, wherein:

the second transistor has a gate electrode coupled to a second node, the fifth transistor is coupled between the second transistor and the OLED, and the fifth transistor is turned on by a low signal on an i-th emission control line;

a third transistor coupled between the gate electrode of the second transistor and an electrode of the second transistor that is coupled to the fifth transistor, the third transistor being turned on by a low signal on an (i−1)-th scan line;

a fourth transistor coupled between a first reference voltage and the first node, the fourth transistor being turned on by the low signal on the (i−1)-th scan line;

a storage capacitor coupled between the first node and the second node; and a compensator controlling a voltage of the second node corresponding to degradation of the OLED, wherein the compensator includes:

a feedback capacitor coupled between the first node and a third node; and a sixth transistor and a seventh transistor disposed in series between a second reference voltage and a fourth node, wherein:

the third node is between the sixth and seventh transistors, and the fourth node is between the fifth transistor and the OLED.

11. The organic light emitting display as claimed in claim 10, wherein the scan driver supplies a scan signal to be provided to an i-th scan line and an emission control signal to be provided to an i-th emission control line to overlap with each other during a partial time period.

12. The organic light emitting display as claimed in claim 11, wherein the emission control signal is supplied to the i-th emission control line when a predetermined time elapses after the scan signal is supplied to the i-th scan line.

13. A method for driving a display, comprising:

initializing a gate electrode of a drive transistor during an initial time period while a low scan signal is supplied to an (i−1)-th scan line, i being a natural number;

supplying a high emission control signal to an i-th emission control line after the initial time period and maintaining the high emission control signal while the low scan signal is supplied to the (i−1)-th scan line in order to charge a storage capacitor with a voltage corresponding to a threshold voltage of the drive transistor;

charging the storage capacitor with a voltage corresponding to a data signal while a low scan signal is supplied to an i-th scan line; and controlling a voltage of the gate electrode of the drive transistor in correspondence with degradation of an OLED, wherein controlling the voltage of the gate electrode of the drive transistor includes:

providing an anode voltage of an anode electrode of the OLED to a first terminal of a feedback capacitor while the low scan signal is supplied to the i-th scan line; and increasing a first terminal voltage of the first terminal of the feedback capacitor while a high scan signal is supplied to the i-th scan line, wherein:

a second terminal of the feedback capacitor is coupled to a first terminal of the storage capacitor, and a second terminal of the storage capacitor is coupled to the gate electrode of the drive transistor.

14. The method as claimed in claim 13, wherein initializing the gate electrode of the drive transistor during the initial time period includes applying a first reference voltage to a first electrode of a storage capacitor, a second electrode of the storage capacitor being coupled to the gate electrode of the drive transistor.

15. The method as claimed in claim 13, wherein controlling the voltage of the gate electrode of the drive transistor further includes reducing a voltage change of the first terminal of the feedback capacitor in correspondence with increasing resistance of the OLED.

16. The method as claimed in claim 15, wherein controlling the voltage of the gate electrode of the drive transistor further includes reducing the voltage of the gate electrode of the drive transistor in correspondence with the reduction in the voltage change of the first terminal of the feedback capacitor.

17. The method as claimed in claim 16, wherein controlling the voltage of the gate electrode of the drive transistor further includes increasing an electric current supplied to the OLED by the drive transistor in correspondence with the reduction in the voltage of the gate electrode of the drive transistor.

18. The method as claimed in claim 13, wherein controlling the voltage of the gate electrode of the drive transistor further includes increasing the first terminal voltage of the first terminal of the feedback capacitor to a second reference voltage while the high scan signal is supplied to the i-th scan line.

19. The method as claimed in claim 13, wherein:

a scan signal having a low pulse is supplied to the (i−1)-th scan line and subsequently supplied to the i-th scan line, an emission control signal having a high pulse is supplied to the i-th emission control line, the emission control signal on the i-th emission control line transitions high after the scan signal on the (i−1)-th scan line transitions low, and the emission control signal on the i-th emission control line transitions low after the scan signal on the (i−1)-th scan line transitions high.

* * * * *